United States Patent [19]

Iannucci

[11] 3,983,912

[45] Oct. 5, 1976

[54] ASSEMBY FOR PREFORMING A PLURALITY OF WIRES DURING HELICAL WINDING

[75] Inventor: Vincent A. Iannucci, West Lawn, Pa.

[73] Assignee: Rockwell International Corporation, Pittsburgh, Pa.

[22] Filed: July 25, 1975

[21] Appl. No.: 599,251

Related U.S. Application Data

[63] Continuation-in-part of Ser. No. 450,930, March 13, 1974, Pat. No. 3,896,860.

[52] U.S. Cl. ..... 140/149; 57/9

[51] Int. Cl.[2] ..... B65H 81/08

[58] Field of Search ..... 140/149, 115; 57/9, 57/55

[56] References Cited

UNITED STATES PATENTS

| | | | |
|---|---|---|---|
| 2,105,338 | 1/1938 | Sunderland | 57/9 |
| 3,896,860 | 7/1975 | Iannucci | 140/149 |

FOREIGN PATENTS OR APPLICATIONS

| | | | |
|---|---|---|---|
| 656,008 | 1/1938 | Germany | 57/9 |

*Primary Examiner*—Lowell A. Larson

[57] ABSTRACT

A wire preforming assembly is fixedly mounted on a circular turntable having thereon a predetermined plurality of bobbins dispersed in an array to provide a predetermined plurality of wires to the assembly equally spaced around its periphery. The assembly and the turntable are coaxially aligned with and relatively rotating about a longitudinally advancing, mandrelled hose. The wires are being directed to the hose by the preforming assembly so that the hose pulls the wires with uniform equal tension and causes them to be simultaneously wrapped thereon in side-by-side parallel helical convolutions. The wire is directed in a helical path around the surface of a preforming tube of the assembly and is bent toward the hose as it is being wound thereon. The bending imparts a characteristic to the wire which causes it to naturally retain the desired helical shape around the hose. A spacing tube is disposed within the preforming tube and around the hose to extend into the path of the wires so that each wire is received within one of a predetermined number of slots at the extended end of the spacing tube and evenly spaced thereabout to insure even spacing of the wires during winding.

12 Claims, 7 Drawing Figures

Fig. 3
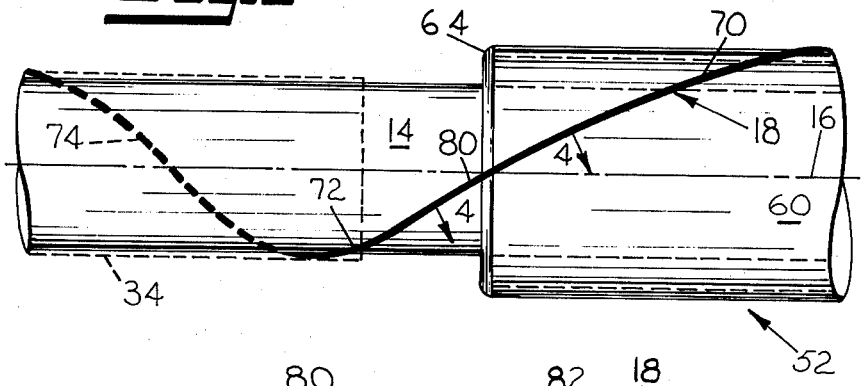
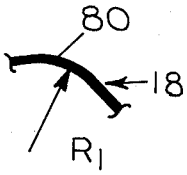
Fig. 4
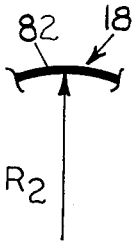
Fig. 5
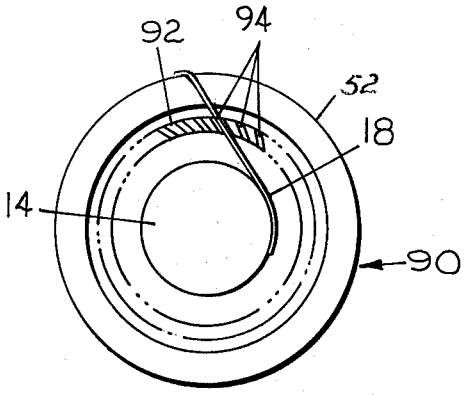
Fig. 7
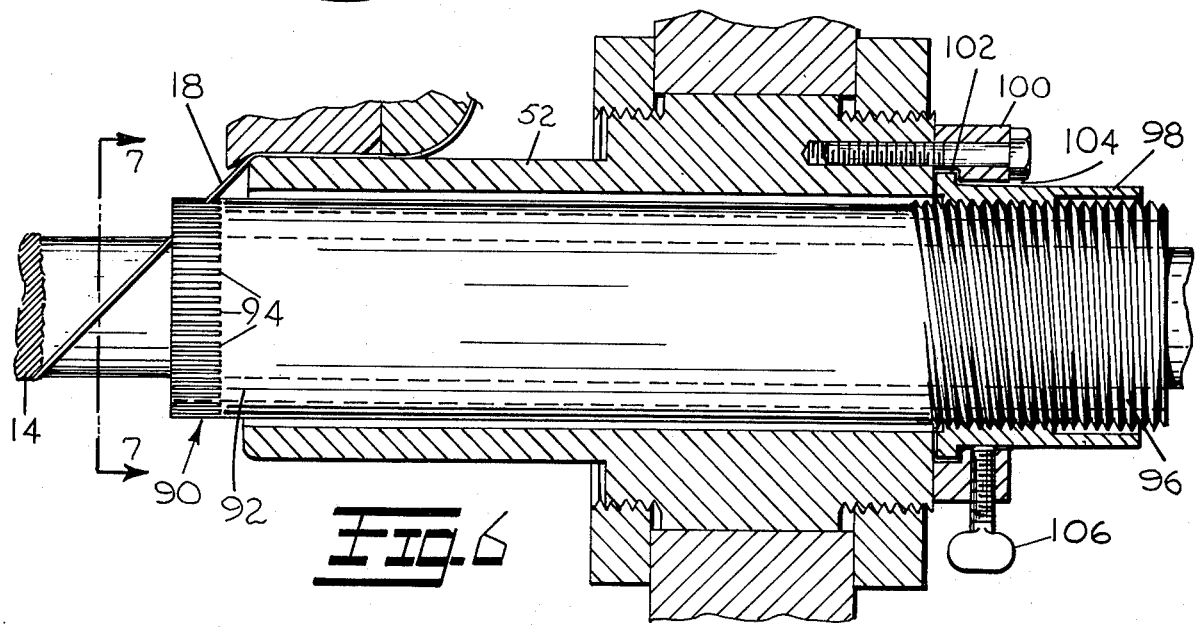
Fig. 6

ASSEMBY FOR PREFORMING A PLURALITY OF WIRES DURING HELICAL WINDING

CROSS-REFERENCE TO RELATED APPLICATION

This is a continuation-in-part of application Ser. No. 450,930 filed Mar. 13, 1974, now issued as U.S. Pat. No. 3,896,860 on July 29, 1975.

BACKGROUND OF THE INVENTION

1. Field of the Invention

This invention relates to an assembly for preforming a number of wires being helically wound about a hose and, more specifically, to such an assembly that can readily accommodate a predetermined number of wires and hoses of a predetermined size.

2. Description of the Invention

It is desirable in the production of high pressure hoses to provide armouring consisting of continuous windings of permanently deformable wires. The high pressure hose may include an inner hose, several layers of armouring which are separated by protective tape, and an outer protective covering. The several layers of armouring are usually in the form of pairs of windings in opposite directions to counterbalance any twisting or bending effect that winding in only one direction might impart to the hose.

A number of means have heretofore been employed to wind a plurality of wires on the inner hose by relative rotation of the respective sources of the wires about the hose. Longitudinally advancing the hose with respect to the sources of the wires continuously presents an unwrapped region of the hose at which the windings may be formed. It has been found that the winding can be accomplished by the prescribed relative movement and that whether the sources of the wire or the hose should be fixed or moving is generally determined by other considerations other than the specific act of forming the windings of the hose.

However, it has long been recognized that simple relative movement of the wire sources and the hose will not insure that the wire will be satisfactorily retained on the hose. The wire which is utilized for armouring is usually relatively resilient and tends to resist the required change in shape from that related to its source to that which is desired for helical wrapping. Therefore, after simple winding, the wires retain a natural resistance to the helical shape, which, if unrestricted, will result in uncontrolled separation of the wire from the hose as a different helical shape, having a different pitch and diameter, is established. If the original helical shape of the wire is maintained during the remaining formation of the high pressure hose, the natural resistance of the wire will generate undesirable internal forces within the high pressure hose that reduce its overall strength and effectiveness.

In an effort to solve this problem, a number of defices have heretofore been utilized in winding machines to preform the wire so that its natural resilience will not be in opposition to the desired helical shape. The preforming devices, such as those disclosed in U.S. Pat. Nos. 3,183,583, 3,187,494, and 3,357,456, have generally included a predetermined number of wire-receiving holes and wire-guiding surfaces for reverse bending of the wire in a region of the wire remote from the point at which it is applied to the inner hose. It appears to have been considered desirable to provide a reversely bent characteristic to the wire at this remote region in anticipation of continued winding about the hose until the remote region is properly oriented with respect to the hose so that the established bend as reoriented will tend to coincide with the shape of the hose. Without having to specifically consider the merits of this reverse bending concept, it should be apparent that because of the essential reorientation of the wire, the location and degree of the reverse bending might vary greatly with hoses having different diameters. Further, if not properly adjusted, any preforming device that institutes a deliberate deformation of the wire at a location remote from the hose can, because of the relative rotation, result in the wire being applied to the hose at an orientation which not only fails to follow the shape of the hose but might even have added resistance to it.

The above-mentioned, wire-receiving holes of the prior preforming devices tend to provide the desirable function of properly and evenly spacing the wire about the periphery of the hose to insure side-by-side alignment during winding. A predetermined number of wire-receiving holes presupposes a predetermined number of wires if even spacing is to be maintained but the time required for initially setting up the winding machines utilizing preforming apparatus that includes these wire-receiving holes is largely determined by the time required for each wire to be threaded through its respective wire-receiving hole.

Accordingly, the preforming devices previously employed in wire wrapping machines have not been readily adaptable to quickly begin wire wrapping hoses even if the diameter of the hose and the number of wires to be used is predetermined.

SUMMARY OF THE INVENTION

It is therefore an object of the present invention to provide an assembly to preform wire so that the internal forces within the wire will be minimized so it will retain the helical shape established as it is being wound about a hose.

It is another object to provide a preforming assembly of the type described which can be readily adapted to accommodate hoses having different but predetermined diameters and to change the predetermined number of wires being wound.

It is still another object to provide a preforming assembly of the type described which requires a relatively short set-up time and is easily adjustable to insure satisfactory helical winding of the wire about the hose.

To accomplish these and other objects of the invention, a preferred preforming assembly preforms a plurality of wires being wound on an elongated member. The wires are supplied from sources which are relatively rotated about and relatively displaced along the longitudinal axis of the elongated member to cause the wires to be wound on the elongated member in a helical shape. The preforming assembly includes means for guiding the wire along a substantially helical path coaxially aligned with the elongated member and having a diameter greater than the diameter of the helical shape and means for bending the wire toward the elongated member as it leaves the helical path through a curved path having a radius less than the effective radius of the helical shape. A spacing means insures that, for each elongated member having a predetermined diameter and wound with a predetermined plurality of wires, the wires will be maintained in an evenly spaced manner about the elongated member throughout winding.

BRIEF DESCRIPTION OF THE DRAWINGS

FIG. 3 is a view of the preforming assembly as seen along line 3—3 of FIG. 2;

FIG. 4 is a view of the wire as seen along line 4—4 of FIG. 3;

FIG. 5 is a view of the wire as seen along line 5—5 of FIG. 2;

FIG. 6 is an exploded view of the preforming assembly as seen in FIG. 1, including the spacing tube of the present invention;

FIG. 7 is a view of the spacing tube as generally seen along line 7—7.

DETAILED DESCRIPTION OF THE PREFERRED EMBODIMENT

Figure 1:
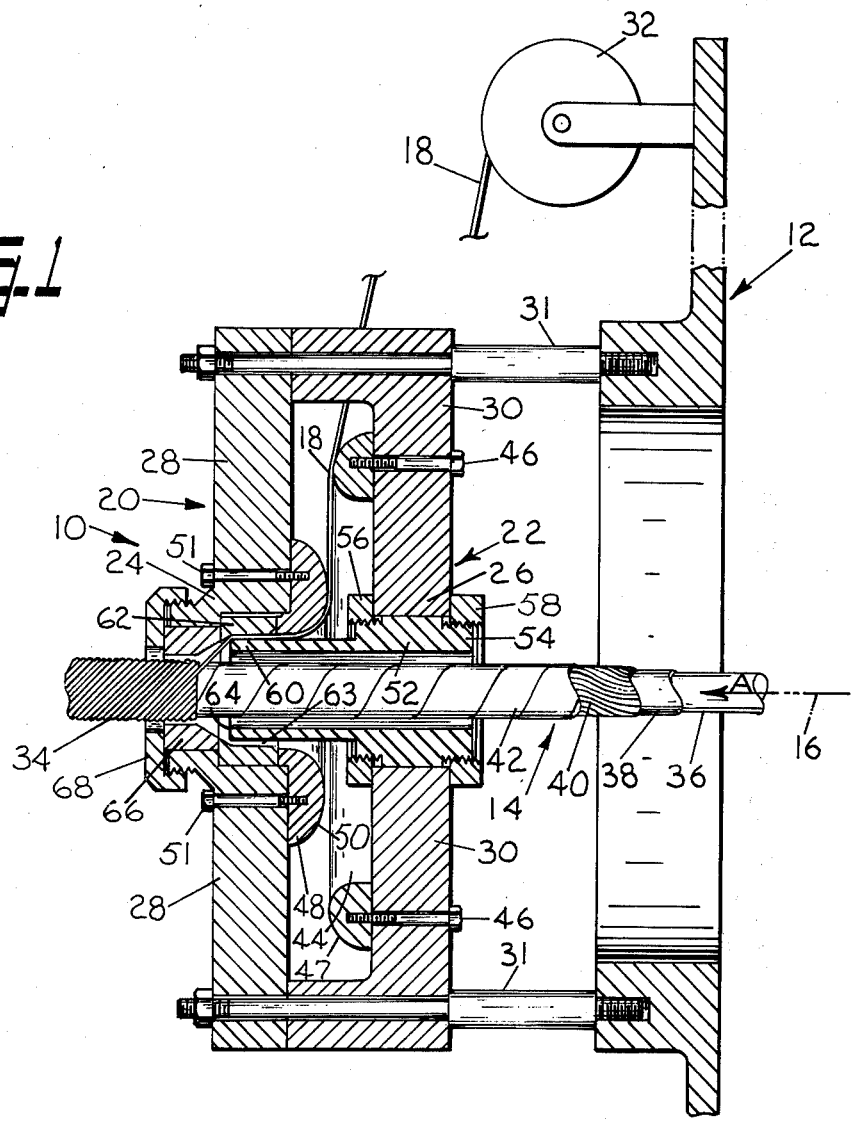
FIG. 1 is a sectional side view of the preferred wire preforming assembly including various features of the invention.

As seen in FIG. 1, the preferred preforming assembly 10 is fixedly mounted on a wire supply turntable 12 which, in the preferred configuration, rotates about a hose work product 14 in a clockwise direction when viewed from the right. The turntable 12 may be one of a number of types associated with spiral winders known to those skilled in the wire wrapping art, such as the ROCKWELL WSW-III Precision Wire Spiral Winder. The winder is oriented so that the turntable 12 is coaxially aligned with the hose work product 14 along a common central axis 16.

To provide the remaining relative motion between the wire supply and the hose work product 14 which causes the wire 18 to be wound about the hose work product 14 in a generally helical shape the hose work product 14 is pulled, in the preferred configuration, to the left as indicated by the arrow A, without any rotation about its axis 16. Several means for longitudinally pulling of the hose work product 14 are known to those skilled in the wire wrapping art such as a caterpillar extractor like the ROCKWELL Heavy-Duty Caterpillar Haul-Off or the type disclosed in U.S. Pat. No. 3,183,583.

Although in this preferred configuration the wire supply is rotated and the hose work product is pulled longitudinally with respect to the wire supply, it is the relative motion therebetween which is essential for the wire wrapping. With the above-described relative motion established so that each wire source and the hose work product move in a generally helical path with respect to each other, the wire will be laid in a helical shape about the hose work product. The diameter of the helical shape is of course established by that of the hose work product and the pitch of the helical shape is determined by the length of relative longitudinal movement for each revolution about this known diameter. Therefore, it is not the purpose of this invention to establish the helical shape of the wire about the hose work product, but to preform the wire being so wound such that the internal forces within the wire established by the preforming will cause the wire to generally assume this helical shape even if it were not supported by the hose work product. If the wire is not preformed, the wire will have internal resilience which will tend to cause it to change its pitch and diameter and unwind from its contacting helical shape about the hose work product.

The preforming assembly 10 includes a forward frame and a rearward frame 22, respectively, having hollow hub portions 24 and 26 coaxially aligned with the axis 16. Further, each frame 20 and 22, respectively, includes several spokes 28 and 30 by which the preforming assembly 10 is fixedly mounted on the turntable 12 by post 31 and to which other elements of the preforming assembly 10 are secured.

Each wire 18, only one of which is shown in FIG. 1, is supplied from a bobbin 32 on the turntable 12 and is directed between the frames 20 and 22 to the hose work product 14 with other wires 18 to be simultaneously wrapped thereon in side-by-side parallel helical convolutions as seen at 34. The typical hose work product 14 shown in FIG. 1 includes a central mandrel 36, an inner hose 38, a set of windings 40, and insulating tape 42. A mandrel 36 is often placed within the inner hose 38 because the pulling force by the work product 14 required to wind and form the wires 18 could cause it to collapse without the support of the mandrel 36. The mandrel 36 is removed from the finished hose. The set of windings 40 is formed by rotation in the opposite direction from that for forming windings 34 and the insulating tape 42 is wound therebetween for the reasons discussed hereinabove.

In the preforming apparatus 10, it is desirable to cause each wire to be guided along a generally helical path having a diameter greater than that of the hose work product 14. Although this feature and its purpose will be shown in other figures and discussed in detail hereinbelow, recognizing this feature is of an assistance when explaining the purpose of other elements of the preferred preforming assembly 10. A first gathering ring 44 is mounted on the rearward frame 22 by a bolt 46 at each spoke 30. Since the bobbins 32 are located at various radii on the turntable 12, the first gathering ring 44 includes a gradually curved surface 47 over which each wire 18 must pass so that they may all be directed toward the interior of the preforming assembly 10 at the same approach angle. A second gathering ring 48 which also has a gradually curved surface 50 is mounted on the forward frame 20 by bolts 51 and generally faces toward the surface 47 of the first gathering ring 44. The second gathering ring 48 has a smaller diameter than the first gathering ring 44 so that the wires 18 can be equally spiraled from their bobbins 32 toward the region between the hubs 24, 26 of the forward frame 20 and rearward frame 22.

A preforming tube 52 is centrally mounted at the hub 26 of the rearward frame 22 to extend forwardly toward the frame 20 in a region within its hub 24. The preforming tube 52 is intended to provide a surface about which the wire 18 can be directed in a generally helical path as discussed above. The preforming tube 52 has a rearward portion 54 slidably engaged with the center of the hub 26. Each end of the rearward portion 54 is threaded so that an adjustment nut 56 may be turned for accurate longitudinal positioning of the tube 52 with respect to the rearward frame 22 and, because the longitudinal displacement between the frames 20 and 22 is fixed, with respect to the forward frame 20. The periphery of the adjusting nut 56 is marked for an accurate indication of the position of the preforming tube 52 and a locking nut 58 acting on the opposite side of frame 22 insures that the tube 52 will be maintained in the set position. The significance of the adjustments of the tube 52 will also be discussed in detail hereinbelow.

As the wire 18 gradually curves around the surface 50 of the second gathering ring 48, it is naturally wound about a forward portion 60 of the preforming tube 52 by the pulling effect of the hose work product 14. The wire 18 is not shown in FIG. 1 to have the generally helical path that actually exists about the tube 52 so that its total path to the hose work product 14 from the bobbin 32 may be shown.

A floating collar 62 is mounted within the hub 24 of the forward frame 20 to closely encircle the forward portion 60 of the tube 52. The thickness of a space 63 between the floating collar 62 and the forward portion 60 of the tube 52 and the thickness of the wire 18 are exaggerated in FIG. 1 for ease of demonstration. The space 63 is defined by the inside diameter of the collar 62 and the outside diameter of the forward portion 60 and is sufficiently close to the diameter of the wire 18 to insure that the wires are not doubled around the surface of the forward portion 60 and are all lying in parallel helical paths thereon. The floating feature of the collar 62 allows uniform spacing 63 between the collar 62 and the forward portion 60 to insure that the wire will be evenly pulled therethrough.

As the wire 18 is pulled from the surface of the forward portion 60, it passes over a preforming edge 64 of the tube 52 toward the hose work product 14. The hose work product 14 with the wires wrapped thereon then moves through a support bushing 66 secured at the hub 24 of the forward frame 20. The bushing 66 is selected to conform to the size of the hose work product for sliding contact therebetween to insure that the hose work product is maintained centrally aligned with the preforming assembly 10. A retaining cap 68 is threadedly secured to the hub 24 of the forward frame 20 to allow different support bushings to be easily installed to provide support for work products having different diameters.

Having provided a description of the overall relationship of the preforming assembly 10 to the winding process, FIGS. 2–5 are presented to allow a detailed description of the preforming feature which imparts to the wire a characteristic which results in improved windings for the hose work product 14. The preferred preforming tube 52 has an outside diameter at the forward portion 60 of about 3½ inches. The preforming edge 64 is rounded to curve inwardly from the outside surface of the forward portion 60 with a radius of about ⅛ of an inch. A preforming tube having these dimensions has been effectively used for winding wire with a 0.012 inch diameter or a hose work product having diameters ranging between ⅜ of an inch and 3 inches. The hose work product 14 shown in the Figures has a diameter of about 2¼ inches.

Figure 2:
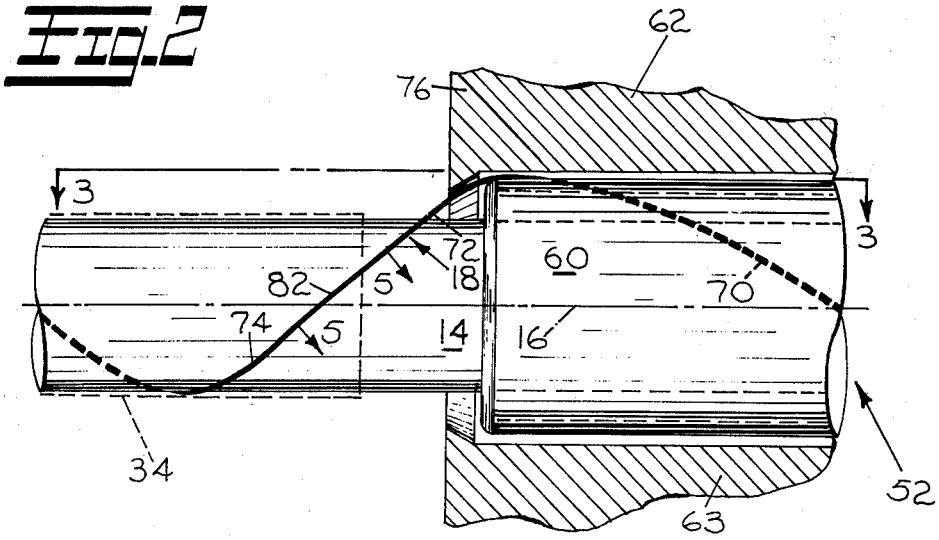
FIG. 2 is a view like that of FIG. 1 exploded to show the preforming region.

As seen in FIG. 2 in an exploded view of the preforming area, the particular wire 18 shown follows a generally helical path 70 around the inside surface of the forward portion 60 of the preforming tube 52 to the preforming edge 64 at the top of the tube 52. The helical path 70 is established for each wire 18 during winding so that the only relative motion between the surface of the forward portion 60 and the wire 18 occurs as the wire 18 moves longitudinally along the established path 70.

The wire 18 is bent over the preforming edge 64 as it is pulled from the helical path 70 toward the hose work product 14. The wire 18 makes initial contact with the hose work product 14 at 72 to join the other wires to form the helical convolutions 34 with a helical shape 74 predetermined by the relative motion described hereinabove.

As the wire 18 leaves the edge 64, it passes freely by a deflecting lip 76 on the forward portion of the floating collar 62. When the hose work product 14 has a diameter relatively close to that of the preforming tube 52, the deflecting lip 76 may not be needed to insure proper bending of the wire 18 at the edge 64. Therefore, its significance will be discussed later in a discussion of preforming wire for hose work products having relatively small diameters.

When viewed from the top as in FIG. 3, it can be seen that, by following the helical path 70, the wire 18 approaches the edge 64 at an angle. Therefore, since the helical path 70 aligns the wire 18 in a general direction to be helically wound on the hose work product, the bending about the preforming edge 64 is not in a plane perpendicular to the preforming edge 64 but in a plane more aligned with the effective curve of the wire when in the predetermined helical shape.

In FIG. 4, it can be seen that the friction force on the wire 18 as it slides along the helical path 70 and the pulling force on the wire 18 by the winding on the hose work product 14 causes the wire 18 to be deformed at the preforming edge 64 through a curve 80 having a radius $R_1$. As the wire 18 lies on the hose work product 14 in the helical shape 74, an effective curve 82 of the wire 18 has an effective radius $R_2$ as shown in FIG. 5. It has been found that when preforming apparatus is properly adjusted for each hose work product according to its specific diameter and helical shape the bending radius $R_1$ will be less than the effective radius $R_2$ for that specific helical shape. Further, since the helical path 70 is generated by and tends to be aligned with the helical shape according to its particular diameter and pitch, it has also been found that the curve 80 will be properly oriented with the effective curve 82 of the particular helical shape.

It is generally felt that the bending of the wire 18 at preforming edge 64 through the radius $R_1$ as described above imparts to the wire 18 a memory which causes the wire 18 to relax to an effective radius $R_2$ of the helical shape 74. The deformation of the wire 18 causes the internal resistance of the wire to be re-established so that it will retain the helical shape 74.

When winding about hose work products having a diameter significantly less than that of the forward portion 60 of the preforming tube 52, it is difficult to maintain the radius $R_1$ smaller than the effective radius $R_2$ for these smaller hose work products by pulling the wire over the preforming edge 64 alone. Therefore, to provide the desired radius $R_1$, the preforming tube 52 is longitudinally adjusted toward the deflecting lip 76 of the floating collar 62. Causing wire 18 to be contacted by the deflecting lip 76 allows finer control of the bending while providing the smaller radius $R_1$. The angle and extension of the deflecting lip 76 is selected to insure that it will not extend sufficiently into the path of the wire 18 to cause the wire 18 to be reversely bent around the lip 76. It should be apparent that, although in the preferred preforming assembly 10 the preforming tube 52 is mounted for longitudinal movement with respect to the deflecting lip 76, the same desired relative movement could be obtained by an alternative means which allows for movement of the collar 62 toward the preforming tube 52.

There are a number of desirable features which the preferred preforming assembly 10 provides besides that of general alignment of the helical path and deformation through the radius smaller than the predetermined effective radius of the helical shape. For example, the natural spacing of the wires about the preforming tube 52 allows the preforming assembly 10 to be set-up in a relatively short time. The preforming tube 52 is initially withdrawn from the area of the floating collar 62 as the wire ends are secured to the hose work product. Several revolutions of the wires about the hose work product causes the wire to begin spiraling from the bobbins. Having generally established the spacing in this manner, the preforming tube 52 is moved longitudinally for insertion into the floating collar 62. As this is being done, the wires are individually positioned so that they do not cross or lie on top of each other. The tube 52 may then be received within the collar 62 to maintain the wires in their relative positions. When the tube 52 is properly adjusted for preforming, the evenly spaced helical paths will be automatically established by the winding.

Even though the number of wires to be wound are considered when setting the winder and the extractor for the predetermined helical shape of each wire, it is frequently found that the spacing is insufficient to allow all of the wires to lie on the surface of the hose work product so that one wire will instead ride on the other wires. With the preferred preforming assembly, one or more wires can be simply cut and removed from the total being wound since the retaining wires will automatically be repositioned about the preforming tube to provide the desired armouring.

When discussing the preforming means hereinabove, one aspect of the wire was not mentioned. It is acknowledged that the wire is initially preformed by being wound on the bobbins. Further, the general bending about the gathering rings also affects the characteristics of the wire. However, pulling the wire through the helical path and bending the wire about the relatively small radius $R_1$ has a greater overriding effect on the wire so that the abovementioned gradual deformations have an insignificant effect on the internal force eventually established.

Another aspect of the preforming assembly eliminates an adjustment which is often required for other preforming devices. When wire is deformed, a force must be applied at opposite sides of the area of deformation. One force is provided by the pulling of the hose work product during winding but the other force is often substantially provided by a braking action on the bobbins. Individually adjusting the braking on the bobbins is critical and time consuming. As mentioned above, the second force at the preforming edge is primarily provided by the sliding friction along the helical path. The sliding friction is substantially equal on all of the wires so that critical individual adjustments of the bobbins are not required.

It has been found for many applications of the present invention that a significant quantity of hose, having the same predetermined diameter and the same predetermined number of wires, are to be manufactured. Accordingly, as seen in FIGS. 6 and 7, a spacing tube 90 has been added to the basic preforming assembly 10. The spacing tube 90 is utilized to insure rapid, even spacing of the wires 18 about the preforming tube 52 and, thus, the hose work product 14, to minimize the number of starting revolutions which are required to establish the natural spacing mentioned hereinabove. Additionally, the natural spacing as previously discussed generally contemplates about 95 to 100 per cent coverage of the work product by the wires so that as the wires are evenly positioned on the surface of the work product, the relative spacing is reflected back to the preforming tube. Consequently, if less coverage is desired, the space between adjacent wires on the work product may vary. Similarly, the spacing at the preforming tube could be uneven. It is with this situation that the spacing tube 90 is particularly helpful. The spacing tube 90 will establish even spacing on the work product 14 which will again be reflected back to the surface of the preforming tube 52 as the wire seeks the path of least resistance. Once even spacing on the tube 52 is established, the wire 18 tends to continuously move along the path 70 only, so that the spacing tube 90 is not likely to be used except when a new wire is added to replace one that is broken or fully expended from its bobbin.

The forward end 92 of the spacing tube 90 includes a plurality of slots 94, one for each of the predetermined number of wires 14. The slots 94 are equally spaced about the circumference of the forward end 92 to insure that the desired spacing is established and maintained. Each slot 94 is parallel with the axis of the tube 90 but extends through the forward end 92 at the angle determined by and consistent with the predetermined diameter of the hose work product. The slot 94 is oriented to accommodate the wire as it is wrapped about the hose work product and is, therefore, generally tangentially aligned therewith. Accordingly, the slot 94 defines a plane which is generally tangential to the surface of the hose work product. In a typical installation, a spacing tube 90 includes 94 slots 94 for an equal number to wires 18 with a 0.022 inch diameter. With a hose work product having a diameter of about 1.219 inches and a helical pitch of about 2.865 inches, this wire would be wound about the hose work product to provide about 91 per cent coverage.

Although the winding machine described herein provides one layer of wire wound about the hose work product, a truly typical installation might involve four layers being wound simultaneously. With four winding operations, such as the one described above, four turntables, bobbin arrays, and preforming assemblies, and thus four spacing tubes, would be needed. The tubes might include a different or identical number of slots. It should be apparent that as each layer is applied, the diameter of the hose work product will be slightly increased. Continuing with the installation requirements begun above, the second spacing tube would also accommodate 94 wires and wind the wires about the hose work product at the same pitch. However, in this case the diameter would be about 1.271 inches for 89 per cent coverage. It should be noted, as discussed above, that the winding will be generated in the opposite direction so that the slots would have to be reoriented accordingly. A third layer would be applied in the same direction as the first on a 1.323 diameter hose work product for 88 per cent coverage. The fourth layer would be at a 1.375 inch diameter for 87 per cent coverage.

In the preferred installation, each slot 94 is provided with a width sufficiently larger than the thickness of the wire 18 to prevent its interference with the preforming and winding discussed hereinabove. To simplify tooling, it might be desirable for the four spacing tubes of a typical installation to be similarly dimensioned. In this case, the slots 94 could further be provided with sufficient width to accommodate the full range of diameters expected to allow their utilization at any location during the multi-layer winding process.

To facilitate mounting and installation of the spacing tube 90, its rearward end 96 is threaded. An adjusting nut 98, having internal threads, is capable of being received on the rearward end 96. As seen in FIG. 6, a retaining collar 100 is bolted to the rearward end 54 of the preforming tube 52 to locate the adjusting nut 98 with the spacing tube 90 received therein as it extends inwardly within the preforming tube 52.

During initial installation, the retaining collar 100 allows rotation and some radial floating of the adjusting nut 98 by providing a clearance at 102 and 104. The spacing tube 90 is moved into and/or out of position by the mating threads by its being held against rotation as the adjusting nut 98 is rotated. Proper alignment is obtained when the forward end 92 extends slightly beyond the wires 18 but does not interfere with the wires 18 because of their having been received within the slots 94. There should be no contact of the wires 18 by the spacing tube 90 in an axial direction and any contact at the sides of any slot 94 will eventually be substantially eliminated once the helical paths 70 are established about the preforming tube 52. Having obtained the proper insertion during initial installation, a thum screw 106 mounted on the retaining collar 100 is tightened against the adjusting nut 98 to prevent its further rotation.

The mounting configuration described hereinabove includes features intended to accommodate the natural spacing tendency of the invention rather than producing undesired interference therewith. For example, when initially inserting the spacing tube 90, it can be rotationally oriented to provide the least resistance to wire formation. Even after the thumb screw 106 is tightened, the spacing tube 90 is free to rotate, if required, when acted upon by the wires as they collectively seek their evenly spaced helical paths. This rotation will slightly thread the spacing tube 90 inwardly or outwardly of the stationary adjusting nut 98. However, any rotational orientation expected would be so small that the slight axial repositioning caused by rotation about the threaded mounting would not be significant enough to cause either withdrawal of the tube from between the wires as they extend toward the hose work product or insertion of the tube to the point of interference.

It is felt that the invention and many of its attendant advantages will be understood from the foregoing description and it will be apparent that various changes may be made in the form, construction and arrangement of the various elements of the preforming assembly described without departing from the spirit and scope of the invention or sacrificing its material advantages, the form hereinabove described being merely a preferred embodiment thereof.

What is claimed is:

1. A preforming assembly capable of preforming a predetermined number of wires being wound in side-by-side convolutions on a hose work product, said wires being supplied from bobbins mounted in an array about a support table as said support table is being relatively rotated about and relatively displaced along the longitudinal axis of said hose work product to cause each said wire to be wound on said hose work product in a helical shape, said preforming assembly comprising:

a support structure capable of being rigidly mounted to said table;

a preforming tube mounted at a first end on said support structure for extension away from said table in a direction for alignment with said longitudinal axis;

said preforming tube having an opening for receiving said hose work product therethrough and a cylindrical outside surface which is coaxially aligned with said hose work product received within said opening and has a diameter greater than the diameter of said helical shape;

said preforming tube having a preforming edge at its second end which edge includes a surface extending generally inwardly from said cylindrical surface; and means for evenly spacing said wires about said preforming tube and along said hose work product, said means for evenly spacing said wires being capable of relative rotation with respect to said preforming tube during winding of said wires about said hose work product.

2. A preforming assembly capable of preforming a predetermined number of wires being wound in side-by-side convolutions on a hose work product, said wires being supplied from bobbins mounted in an array about a support table as said support table is being relatively rotated about and relatively displaced along the longitudinal axis of said hose work product to cause each said wire to be wound on said hose work product in a helical shape, said preforming assembly comprising:

a support structure capable of being rigidly mounted to said table;

a preforming tube mounted at a first end on said support structure for extension away from said table in a direction for alignment with said longitudinal axis;

said preforming tube having an opening for receiving said hose work product therethrough and a cylindrical outside surface which is coaxially aligned with said hose work product received within said opening and has a diameter greater than the diameter of said helical shape;

said preforming tube having a preforming edge at its second end which edge includes a surface extending generally inwardly from said cylindrical surface; and means for evenly spacing said wires about said preforming tube and along said hose work product, said means for evenly spacing said wires including a spacing tube coaxially aligned with said hose work product and said preforming tube and disposed therebetween, said spacing tube having in a forward end thereof a predetermined number of slots evenly spaced about its circumference, said predetermined number of slots capable of respectively receiving said predetermined number of wires as said wires extend from said preforming tube toward said hose work product, and each said slot being parallel with said longitudinal axis.

3. A preforming assembly capable of preforming a predetermined number of wires being wound in side-by-side convolutions on a hose work product, said wires being supplied from an array of bobbins encircling said hose work product and being relatively rotated about and relatively displaced along the longitudinal axis of said hose work product to cause each of said wires to be wound on said hose work product in a helical shape, said preforming assembly comprising:

a preforming tube mounted to extend along said longitudinal axis from said array of bobbins during winding;

said preforming tube having a cylindrical outside surface portion which is coaxially aligned with said hose work product and has a diameter greater than the diameter of said helical shape;

said cylindrical outside surface portion being generally disposed between said array of bobbins and said work hose product during winding so that said wires are drawn by said relative rotation and said relative displacement of said array of bobbins and said hose work product along helical paths around said cylindrical outside surface portion;

said cylindrical outer surface portion terminating at a preforming edge of said preforming tube;

said each of said wires capable of being deformed about said preforming edge through a curved path as said each of said wire is drawn toward said hose work product from its respective said helical path;

said curved path having a radius less than the effective radius of the effective curve of said helical shape; and means for evenly spacing said helical paths about said cylindrical outer surface portion and said helical shapes along said hose work product, said means for evenly spacing being capable of relative rotation with respect to said preforming tube during winding of said wires about said hose work product.

4. A preforming assembly capable of preforming a predetermined number of wires being wound in side-by-side convolutions on a hose work product, said wires being supplied from an array of bobbins encircling said hose work product and being relatively rotated about and relatively displaced along the longitudinal axis of said hose work product to cause each of said wires to be wound on said hose work product in a helical shape, said preforming assembly comprising:

a preforming tube mounted to extend along said longitudinal axis from said array of bobbins during winding;

said preforming tube having a cylindrical outside surface portion which is coaxially aligned with said hose work product and has a diameter greater than the diameter of said helical shape;

said cylindrical outside surface portion being generally disposed between said array of bobbins and said hose work product during winding so that said wires are drawn by said relative rotation and said relative displacement of said array of bobbins and said hose work product along helical paths around said cylindrical outside surface portion;

said cylindrical outside surface portion terminating at a preforming edge of said preforming tube;

said each of said wires capable of being deformed about said preforming edge through a curved path as said each of said wire is drawn toward said hose work product from its respective said helical path;

said curved path having a radius less than the effective radius of the effective curve of said helical shape; and means for evenly spacing said helical paths about said cylindrical outside surface portion and said helical shapes along said hose work product, said means for evenly spacing said helical paths and said helical shapes including a spacing tube coaxially aligned with said hose work product and said cylindrical outside surface and disposed therebetween, said spacing tube having in a forward end thereof a predetermined number of slots evenly spaced about its circumference, said predetermined number of slots capable of respectively receiving said predetermined number of wires as said each of said wires is drawn toward said hose work product, and each said slot being parallel with said longitudinal axis.

5. A preforming assembly as set forth in claim 4 wherein said spacing tube is capable of being selectively moved inwardly and outwardly of said preforming tube for correspondingly receiving and removing said wires from said slots.

6. A preforming assembly as set forth in claim 4 wherein said spacing tube is capable of relative rotation with respect to said preforming tube during winding of said wires about said hose work product.

7. A preforming assembly as set forth in claim 4 wherein said hose work product has a predetermined diameter and a plane defined by each said slot is tangential to said hose work product.

8. A preforming assembly as set forth in claim 7 wherein said slot includes a width sufficiently greater than the thickness of said wire to prevent interference with said deforming of said wire about said preforming edge.

9. A preforming assembly as set forth in claim 8 wherein said width of said slot is sufficiently large to allow said spacing tube to accommodate said hose work product having a range of predetermined diameters as a consequence of multi-layer winding of said hose work product.

10. A preforming assembly as set forth in claim 4 wherein a rearward end of said spacing tube is threaded to receive thereon an adjusting nut, means for mounting said adjusting nut relative to said preforming tube at a region thereof remote from said preforming edge, said mounting means restricting axial movement of said adjusting nut with respect to said preforming tube while allowing rotational movement therebetween.

11. A preforming assembly as set forth in claim 10 further including means for selectively preventing rotation of said adjusting nut with respect to said preforming tube.

12. A winding machine capable of winding a predetermined number of wires about a hose work product comprising:

a support table capable of having a wire supply bobbin for each of said wires mounted in an array thereon;

means for relatively rotating said table about and relatively displacing said table along a longitudinal axis of said hose work product so that said each wire is capable of being wound on said hose work product in a helical shape;

a preforming support structure fixedly secured to said table;

a preforming tube mounted at a first end to said support structure and extending away from said table in a direction for alignment with said longitudinal axis;

said preforming tube having an opening for receiving said hose work product therethrough and a cylindrical outside surface which is coaxially aligned with said hose work product received within said opening and has a diameter greater than the diameter of said helical shape;

said preforming tube having a preforming edge at its second end which edge includes a surface extending generally inwardly from said cylindrical surface; and means for evenly spacing said helical shapes of said wires along said hose work product even if said predetermined number of said wires wound thereon fail to substantially cover said hose work product, said means for evenly spacing being disposed between said preforming tube and said hose work product and capable of relative rotation with respect to said preforming tube during said winding of said wires about said hose work product.

* * * * *